US009179753B2

(12) United States Patent
Huynh

(10) Patent No.: US 9,179,753 B2
(45) Date of Patent: Nov. 10, 2015

(54) FRENCH MANICURE APPLICATION DEVICES, KITS AND METHOD

(75) Inventor: Eric Ngoc Huynh, Fort Lauderdale, FL (US)

(73) Assignee: Ozsoy Organik Ternizlik Urunler Pazarlama Sanayi Ve Ticaret Limited Sirketi, Basaksehir Istanbul (TR)

( * ) Notice: Subject to any disclaimer, the term of this patent is extended or adjusted under 35 U.S.C. 154(b) by 16 days.

(21) Appl. No.: 13/617,340

(22) Filed: Sep. 14, 2012

(65) Prior Publication Data

US 2014/0076342 A1 Mar. 20, 2014
US 2015/0000685 A9 Jan. 1, 2015

Related U.S. Application Data

(60) Provisional application No. 61/626,031, filed on Sep. 19, 2011.

(51) Int. Cl.
*A45D 24/00* (2006.01)
*A45D 7/00* (2006.01)
(Continued)

(52) U.S. Cl.
CPC ..... *A45D 29/004* (2013.01); *A45D 29/00* (2013.01); *A45D 29/18* (2013.01); *A45D 29/22* (2013.01); *A45D 2029/002* (2013.01)

(58) Field of Classification Search
CPC ..... A45D 29/00; A45D 29/004; A45D 29/06; A45D 29/11; A45D 29/12; A45D 29/18; A45D 29/20; A45D 29/22; A45D 2029/002; A45D 33/003; A45D 34/00; A45D 29/007; B65D 23/00; B65D 23/001; B65D 55/00
USPC ..... 132/73, 200, 73.5, 74.5, 75.3, 76.5, 132/285, 293, 305, 317, 319, 320, 333; 206/581, 823; 4/621, 622; 215/6, 215/390–392, 386; 220/640–643, 646, 657, 220/695, 697, 699, 700, 701; 222/576; 401/123, 6–8, 118; D7/316; 434/377, 434/100, 81, 84; D28/56, 57, 61, 62
See application file for complete search history.

(56) References Cited

U.S. PATENT DOCUMENTS 1,282,485 A * 10/1918 Sterling ..... 312/295
1,753,044 A * 4/1930 Culver ..... 132/73
(Continued)

FOREIGN PATENT DOCUMENTS

GB 2461919 A * 1/2010 ..... A61Q 3/02

OTHER PUBLICATIONS http://www.1stdibs.com/furniture/dining-entertaining/ashtrays/hagenauer-wiener-werstatte-bronze-ash-tray-signed/id-f 367738/ (1940).*

*Primary Examiner* — Vanitha Elgart
(74) *Attorney, Agent, or Firm* — Kevin P. Crosby; GrayRobinson, P.A.

(57) ABSTRACT

An apparatus, kit and method for applying a French manicure to a user's own nails or those of a customer using a simple finger guide which permits the positioning of a finger relative to a reservoir of acrylic nail polish powder. In one form, the apparatus is comprised of a finger guide which can be removably associated with an acrylic nail polish powder-containing vessel. Alternative embodiments include those with a finger guide being integrally formed with the vessel/jar. A method for applying a French manicure using the apparatus of the invention is also contemplated. The kit includes a supply of one or more acrylic nail polish powders, a finger guide, and the necessary materials to cause the acrylic nail polish powder to be converted to a solid nail polish coating.

8 Claims, 7 Drawing Sheets

(51) Int. Cl.

| | |
|---|---|
| ***A45D 29/00*** | (2006.01) |
| ***A45D 29/22*** | (2006.01) |
| ***A45D 29/18*** | (2006.01) |

(56) References Cited

U.S. PATENT DOCUMENTS

| | | | | | |
|---|---|---|---|---|---|
| 2,020,100 | A | * | 11/1935 | Boyd | 434/100 |
| 2,032,807 | A | * | 3/1936 | Masbach | 434/100 |
| 2,169,990 | A | * | 8/1939 | Preve | 132/73 |
| D131,311 | S | * | 2/1942 | Sutton | D28/61 |
| 2,296,139 | A | * | 9/1942 | Blair | 434/100 |
| 2,579,450 | A | * | 12/1951 | Libson | 132/73.5 |
| 2,722,224 | A | * | 11/1955 | Blann | 132/74.5 |
| 3,451,399 | A | * | 6/1969 | Schmieding | 132/73 |
| 3,727,792 | A | * | 4/1973 | Levin | 220/700 |
| 3,730,191 | A | * | 5/1973 | Doornbos | 132/73.6 |
| 4,137,929 | A | * | 2/1979 | Grossman | 134/182 |
| 4,287,899 | A | * | 9/1981 | Robichaud | 132/73 |
| 4,321,935 | A | * | 3/1982 | Sussman | 132/73 |
| 4,524,789 | A | * | 6/1985 | Sazdanoff | 132/73 |
| 4,767,648 | A | | 8/1988 | Hokama et al. | |
| 4,964,372 | A | * | 10/1990 | Zeenni et al. | 132/74.5 |
| 5,246,139 | A | * | 9/1993 | Duceppe | 222/1 |
| 5,398,704 | A | | 3/1995 | Dombeck | |
| 5,529,417 | A | * | 6/1996 | Burrlader | 401/129 |
| 5,638,837 | A | | 6/1997 | Juhl et al. | |
| 5,645,090 | A | * | 7/1997 | Juhl et al. | 132/285 |
| 5,778,903 | A | | 7/1998 | Tran et al. | |
| 5,782,248 | A | | 7/1998 | Chang | |
| 5,871,020 | A | * | 2/1999 | DeVone | 132/317 |
| 5,908,035 | A | | 6/1999 | Carroll et al. | |
| 6,070,595 | A | * | 6/2000 | Baltierra | 132/200 |
| 6,085,756 | A | * | 7/2000 | Sexton et al. | 132/73 |
| 6,176,389 | B1 | * | 1/2001 | de Laforcade | 220/695 |
| D440,712 | S | * | 4/2001 | Lu | D28/61 |
| 6,250,311 | B1 | * | 6/2001 | Megna | 132/200 |
| 6,354,304 | B1 | | 3/2002 | Chang | |
| 6,656,484 | B1 | | 12/2003 | Lube | |
| 6,705,327 | B2 | * | 3/2004 | Tilson | 132/201 |
| 7,017,587 | B2 | * | 3/2006 | Kurokawa | 132/73.5 |
| 7,134,440 | B1 | | 11/2006 | Dombeck | |
| 7,165,555 | B2 | * | 1/2007 | Lee | 132/73.5 |
| 7,185,452 | B2 | * | 3/2007 | Brown | 40/310 |
| D587,406 | S | * | 2/2009 | Ruiz | D28/61 |
| 8,092,786 | B2 | | 1/2012 | Park | |
| 8,162,012 | B2 | * | 4/2012 | Kulas | 141/365 |
| 2005/0166940 | A1 | | 8/2005 | South-Mitchell | |
| 2007/0025936 | A1 | | 2/2007 | Park | |
| 2007/0235051 | A1 | * | 10/2007 | Robinson | 132/73.5 |
| 2007/0277841 | A1 | | 12/2007 | Kim | |
| 2008/0173321 | A1 | * | 7/2008 | Le | 132/200 |
| 2008/0236603 | A1 | | 10/2008 | Park | |
| 2010/0083976 | A1 | | 4/2010 | Montana-Selers | |
| 2010/0313904 | A1 | | 12/2010 | Garinger | |
| 2011/0100389 | A1 | | 5/2011 | Tran | |
| 2011/0308539 | A1 | | 12/2011 | Chung | |

* cited by examiner

FRENCH MANICURE APPLICATION DEVICES, KITS AND METHOD

CROSS-REFERENCE TO RELATED APPLICATIONS

This application claims priority under 35 U.S.C. §119(e)(1) upon U.S. Provisional Application Ser. No. 61/626,031, which was filed on Sep. 19, 2011, entitled "French Dip," which is incorporated herein by this reference.

BACKGROUND OF THE INVENTION

1. Field of the Invention

This invention relates to the field of cosmetology, and, more particularly, relates to devices and methods for easily, quickly and accurately applying French tip-style fingernail and toenail treatments.

2. Related Art

Decorating finger and toe nails is an art that has been practiced since as early as the ancient Incas. One style of manicure is called the "French" or "FrenchTip" manicure, and is designed to resemble natural nails. The French manicure is characterized by the use of a natural pink base color with a curved white tip, making it one of the most popular and well known color schemes to be used. French manicures are believed to have originated in 18$^{th}$ century Paris and are still enormously popular today.

Applying the French manicure effect, and, in particular, the curved white tip requires great care, and is a very tedious, labor and time-intensive exercise. First, a curved white tip is painted, and then the pink base color is applied thereover. There are a number of techniques that have been developed to create the curved white tip, but all require a manual application of either brushed on liquid or silica powder using hand and eye coordination.

One device to assist in the shaping of the line of demarcation between the pink base and the white tip is disclosed in U.S. Pat. Nos. 5,638,837 and 5,654,090 to Juhl et al. However, the devices of Juhl still require the manual painting of polish to create the white tip, and do not use the popular and more accurate silica powder based coloring agent.

U.S. Pat. No. 5,398,704 to Dombeck discloses a French manicure template which operates similar to the Juhl product, in that the curved white tip still must be manually painted on.

U.S. Pat. No. 6,656,484 to Lube, et. al. discloses a kit for performing a cosmetic nail treatment, which, again, requires the use of a brush to paint the white tip in the desired shape.

U.S. Patent Application Publication No. U.S. 2011/0100389 to Tran discloses a French manicure scraper tool which is placed over the fingertip and provides a template around which to paint the curved white tip.

Finally, U.S. Patent Application Publication No. U.S. 2010/0313904 to Garinger discloses a template in the form of a shield member which exposes a portion of the fingernail to receive the curved white tip, and then requires the use of a secondary feature of the device to apply a second nail paint to the entire nail. The Garinger device is cumbersome and requires careful manipulation of the two structural features of the device to accomplish the task.

Presently, it has become popular to use acrylic nail powder to apply French manicures, which is even harder to apply in a consistent manner with existing apparatus and methods.

All of the devices known to the inventor require undue manual accuracy and time to achieve a professional looking result. Given the number of manicures and pedicures a nail technician performs each day, if the method of applying the curved white tip in a French manicure can be simplified, the accuracy of the resulting job can be improved, and the physical and mental concentration exerted, and the tedium experienced, by the technician can be reduced.

Therefore, it is a principal object of this invention to make it easier on nail technicians and do-it-yourselfers at home to apply a French manicure.

It is also an object of this invention to increase the degree of accuracy and predictability of the outcome of a French manicure.

It is a further object of this invention to provide an apparatus and method which permits the rapid and consistent application of a French manicure.

SUMMARY OF THE INVENTION

Accordingly, the present invention is directed to an apparatus and method for applying a French manicure to a user's own nails or those of a customer using a simple finger guide which permits the positioning of a finger relative to a reservoir of acrylic nail powder used in the French manicure application process. In its simplest form, the apparatus is comprised of a finger guide which can be removably attached to the rim of an acrylic nail powder-containing vessel such as a jar. Alternative embodiments include those with a finger guide being integrally formed with the vessel/jar.

In addition, a vessel having one or more sloped walls is contemplated. The sloped wall(s) causes the acrylic nail powder in the vessel to remain substantially level.

Other features and advantages of the present invention will be readily appreciated, as the same becomes better understood after reading the following description taken in conjunction with the accompanying drawings.

DETAILED DESCRIPTION OF EXEMPLARY EMBODIMENT(S)

In this document, relational terms, such as "first" and "second," "top" and "bottom," and the like, may be used solely to distinguish one entity or element from another entity or element without necessarily requiring or implying any physical or logical relationship or order between such entities or elements.

The terms "comprises," "comprising," "comprise" or any other variation thereof are intended to cover a non-exclusive inclusion, such that a process, method, article, or apparatus that comprises a list of elements does not include only those elements, but may include other elements not expressly listed or inherent to such process, method, article, or apparatus.

A claim element proceeded by the article "a" or "an" does not, without more constraints, preclude the existence of additional identical elements in the process, method, article, or apparatus that includes the element.

Apparatus

Figure 1:
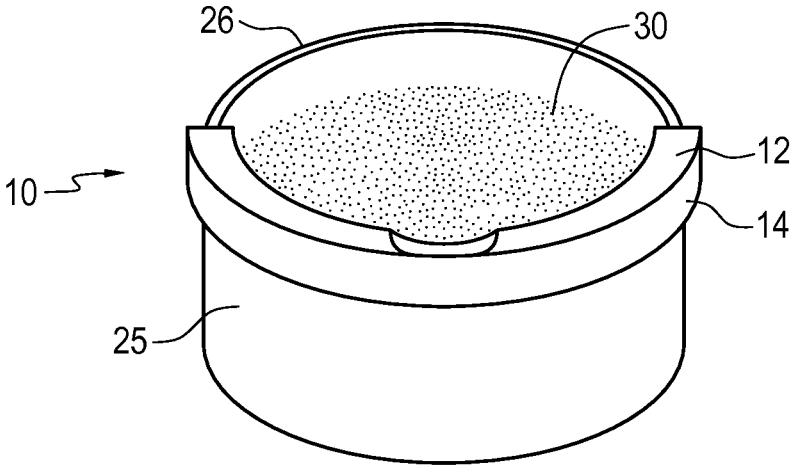
FIG. 1 is a front perspective view of a first embodiment of a finger guide connected to a acrylic nail powder-containing jar.
Figure 2:
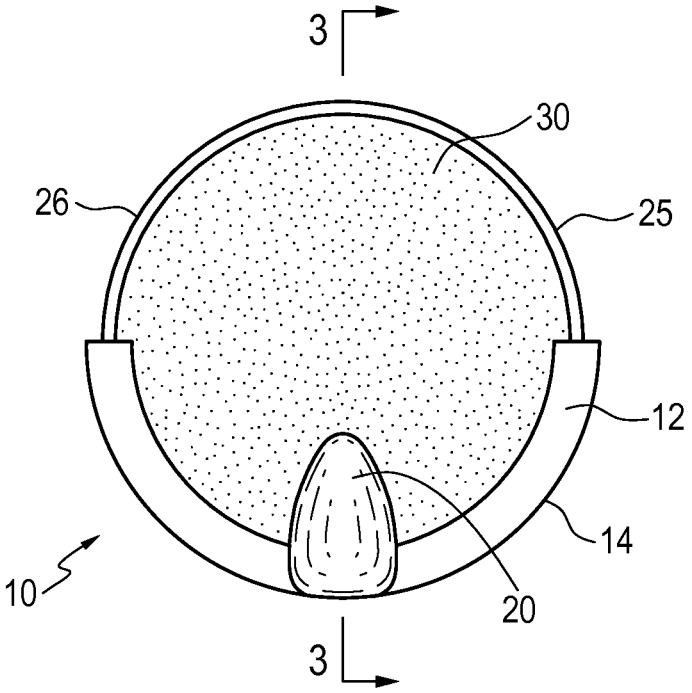
FIG. 2 is a top plan view thereof.
Figure 3:
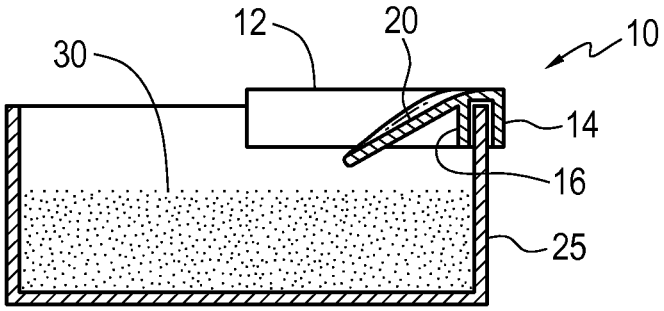
FIG. 3 is a cross-sectional elevational view thereof taken along lines 3-3 of FIG. 2.
Figure 4:
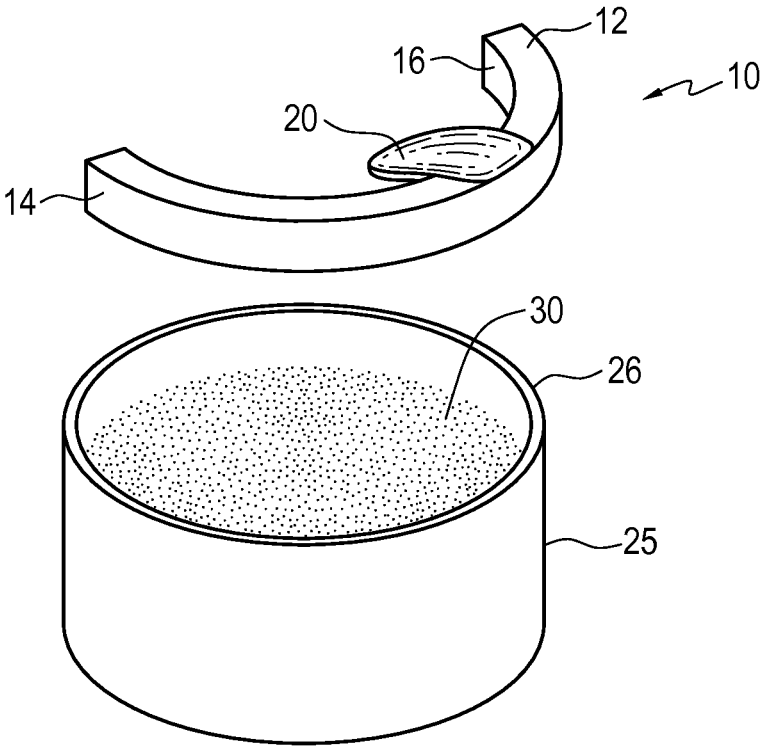
FIG. 4 is a partially exploded view thereof.
Figure 5:
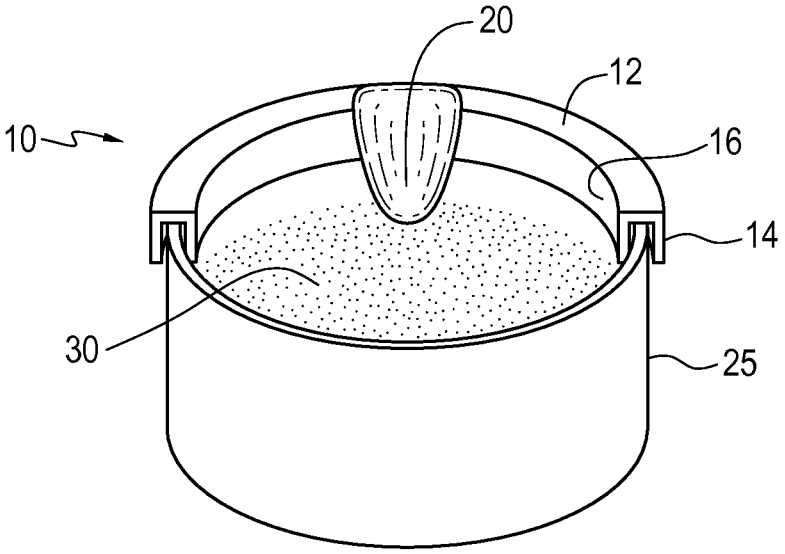
FIG. 5 is a rear perspective view thereof.
Figure 6:
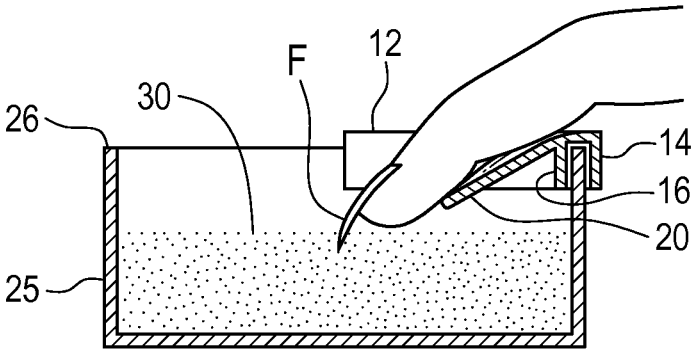
FIG. 6 is a cross-sectional elevational view thereof taken along lines 3-3 of FIG. 2, but with a user's finger being positioned on the finger guide and a the person's fingernail tip being immersed in the acrylic nail powder.
Figure 7:
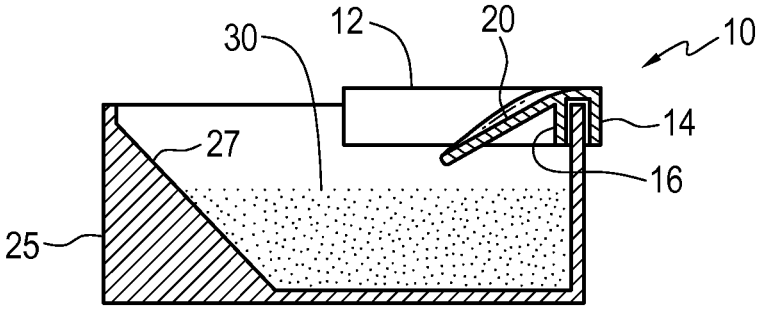
FIG. 7 is a cross-sectional elevational view similar to that shown in FIGS. 3 and 6, but with a sloped interior wall on the jar.
Figure 8:
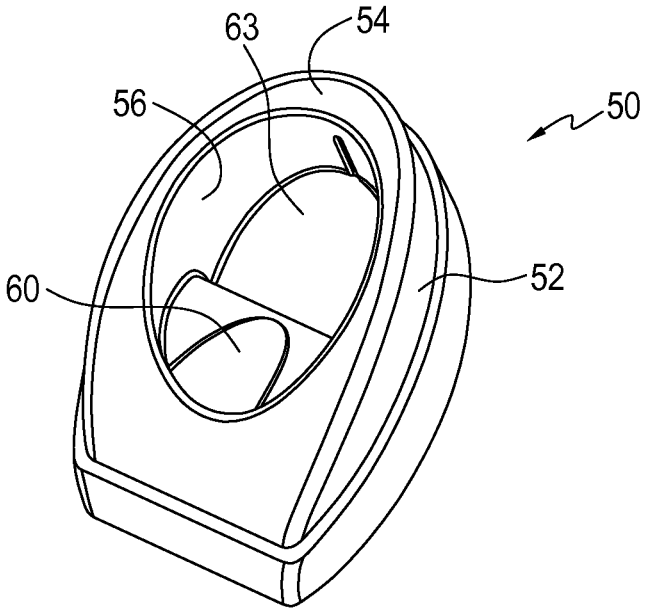
FIG. 8 is a left-front perspective view of an alternative form of a acrylic nail powder container suitable for use in conjunction with the invention.
Figure 9:
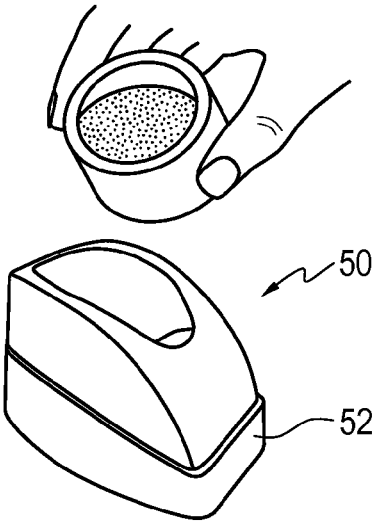
FIG. 9 is a right-front perspective view thereof.
Figure 10:
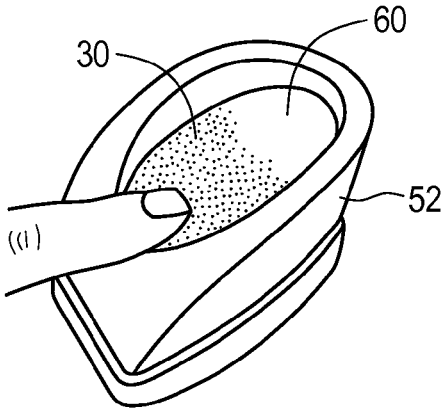
FIG. 10 is a left-front perspective view thereof with a user's finger being positioned on the finger guide.
Figure 11:
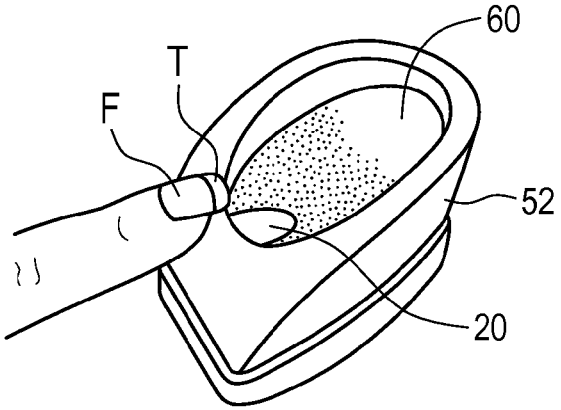
FIG. 11 is a left-front perspective view thereof with the user's finger removed after acrylic nail powder has been deposited on the user's fingernail in the desired crescent shape.
Figure 12:
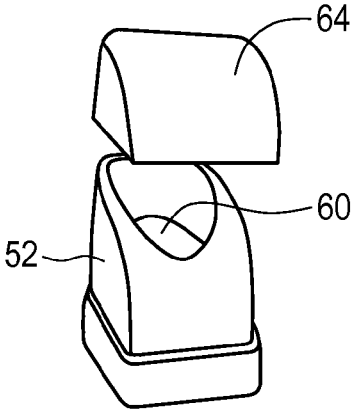
FIG. 12 is a right-front perspective view thereof showing an optional lid.
Figure 13:
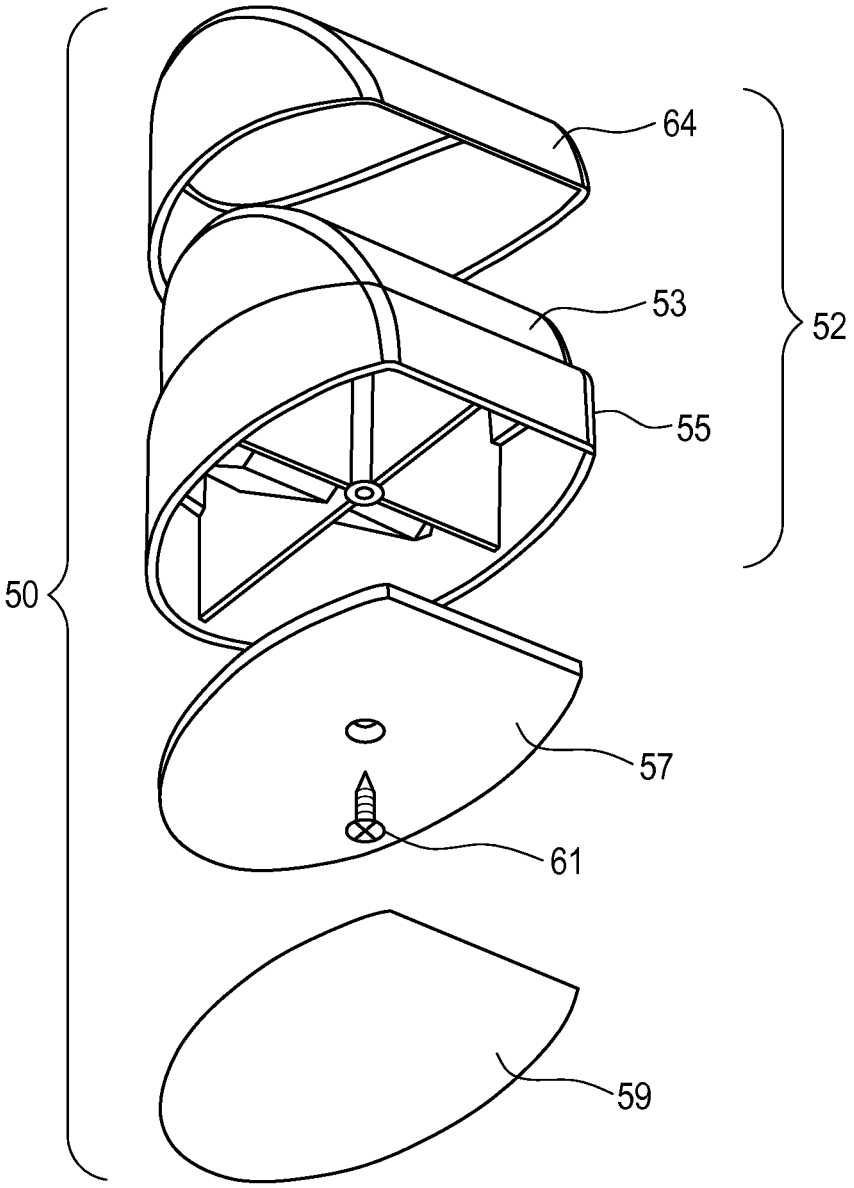
FIG. 13 is a right-bottom perspective exploded view thereof.
Figure 14:
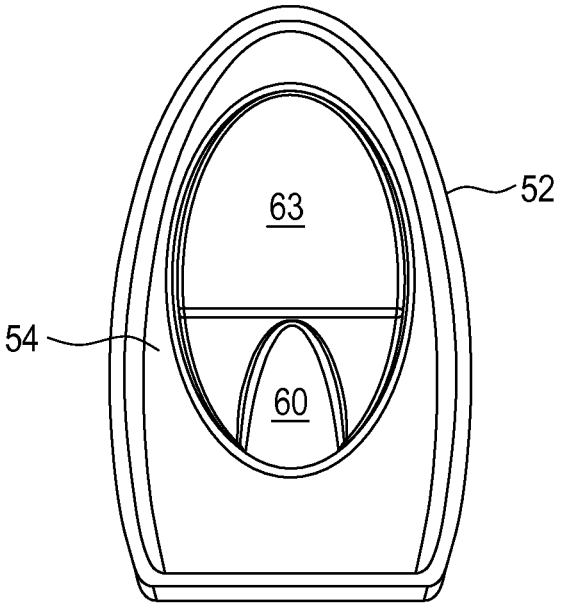
FIG. 14 is a top plan view thereof.
Figure 15:
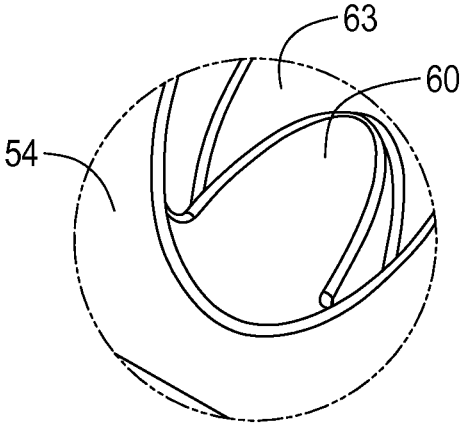
FIG. 15 is a close up view of the finger guide portion of the acrylic nail powder container shown in FIGS. 8-14.

FIGS. 1-6 show a first embodiment of the finger guide of the invention, comprised of a finger guide member 20 supported by a support member 10, which may be comprised of a top wall 12, an outer wall 14 and an inner wall 16 adapted to surround at least a portion of the upper rim 26 of container or vessel 25. Finger guide member 20 is sized, shaped and positioned relative to a reservoir of acrylic nail powder 30 within container 25 to permit, when the finger is located in a particular position (shown in FIG. 6) such that the tip "T" of fingernail "F" of a user is partially submerged in the acrylic nail powder 30. The orientation of finger guide 20 is such that, once an adhesive medium (not shown) such as nail glue is applied to the fingernail and the fingernail tip "T" partially submerged within the acrylic nail powder, the powder will adhere to the fingernail via the adhesion medium in the desired curved shape at the tip "T" of the fingernail "F" shown in FIG. 11.

Support member 10 and finger guide 20 may be retained in position relative to jar 25, and, therefore, acrylic nail powder reservoir 30, by any suitable structural arrangement, the semicircular connection member 10 shown in the drawings being merely exemplary. Other suitable structure may be a completely circular connection member 10, a less than semicircular connection member, a clip-on member extending only underneath finger guide 20, comprised of, for example, outer and inner side walls 14, 16 to surround a small portion of rim 26 of jar 25.

A modification to jar 25 may be in the form of a sloped partial inner wall 27, which will tend to cause the reservoir of acrylic nail powder 30 to remain level during the course of it being used to apply French tips. The slope of inner sloped wall 27 causes the acrylic nail powder 30 adjacent the wall 27 to be urged downwardly through the force of gravity.

The advantage to the use of finger guide support member 10 is that it can be placed over the rim 26 of the jar 25 after the cover of the jar is removed, and itself removed therefrom when it is desired to re-cover jar 25. It is to be noted that jar 25 may be formed in any shape, such as square, without departing from the scope of the invention.

An alternative configuration for jar 25 is shown is FIGS. 8-15, wherein a jar or powder reservoir 50 is comprised of a receptacle 52 having a hollow interior defined by sidewall 56, an upper rim 54 and a finger guide member 60 connected thereto adjacent rim 54. As stated above, it is to be appreciated that the jar 25, receptacle 50 or any acrylic nail powder reservoir-forming receptacle used in connection with this invention may be of any shape. All that is necessary is that one or more finger guides be connectable thereto and supported in a orientation which will facilitate the immersion of a portion of the user's fingernail into the acrylic nail powder.

The specific embodiment shown in FIGS. 8-15 comprises a housing member or receptacle 52, a lid 64, and a bottom plate 57 which may be secured to receptacle 52 via a fastener such as screw 61. A non-slip article such as foam pad 59 may be employed to assist in retaining receptacle 52 in position during use.

Receptacle 52 may or may not employ a sloped inner sidewall 63.

Preferably, the angle of the finger guides 20, 60 is between 35-55 degrees, which is designed to enable the user to orient and insert the finger(s) so that the nail tip can be dipped into the reservoir of powder to a pre-determined depth to form a perfect curved tip. No additional implements are needed to produce the curved tip portion of a French and French white manicure.

Method of Use.

The finger guide apparatus of this invention is utilized as follows: As in the case of any manicure procedure, the work area, clients' hands and technicians' hands should be sanitized. With a nail file, the nails should be cut and filed to the desired shape (e.g., square, round, etc.). Then, the entire nail may be gently roughened with the nail file or buffer to remove any excess cuticle and shine from the nail. Then, any dust should be removed from the nails and hand using a nailbrush.

Then, a preparatory medium, such as an adhesive promoter, should be applied to all nails to be manicured. A suitable adhesion promoter is ethyl acetate, which results in a clean nail prior to application of nail glue in the next step.

Next, working with one finger at a time on one hand, an adhering medium such as nail glue should be applied to three-quarters of the nail, leaving approximately one-quarter of the nail adjacent to the cuticle uncovered. This space allows the nail not to be overly thick near the cuticle and have a natural curve to it. This will also reduce the amount of filing, if any, necessary at the end of the procedure. However, it is to be understood that the entire nail may be covered with the adhering medium. A suitable nail glue is ethyl cyanoacrylate. The adhering medium may be impregnated with supplements such as vitamin A, vitamin E and calcium, and any other supplemental material, to aid in the promotion of nail health.

The next step in the process is to straighten the finger, and place the finger on the finger guide such as 20 or 60 and into the jar 25 or 52. Then, slowly and steadily push the finger forward (or push the jar toward the finger) so that the tip "T" of the fingernail will become submerged in the acrylic nail powder 30 until the desired FrenchTip is applied to the tip of the fingernail. Inserting the fingernail into the powder at a steeper angle creates a tip that is less curved (i.e. has a smaller radius of curvature), while inserting the nail into the powder at a shallower angle results in a tip that is more curved (i.e. has a larger radius of curvature). Therefore, straightening the finger provides more of a curve to the applied powder, and pointing the finger downwardly by bending the distal knuckle of the user's finger while still using the guide member to support the finger creates less of a curve. Then, upon removing the fingertip from the acrylic nail powder 30, the finger may be tapped to remove any excess silica powder. It is to be understood that like steps may be undertaken to apply polish to toenails.

Thereafter, the entire nail may be dipped into a second color powder such as pink or clear acrylic nail powder, and the finger tapped again to remove any excess powder.

Then, a second coat of adhering medium should be applied to the entire nail, ideally leaving a small space (e.g. 1 mm) between the adhering medium and the cuticle, but while ideally getting as close to the cuticle as possible.

The steps of immersing the fingernail tip "T" partially into the powder, tapping the excess white powder away, and immediately dipping the entire nail into a pink or clear powder, may be performed to add an additional layer of acrylic nail powder to the nail. Thereafter, a third coat of adhering medium may be gently applied to the entire nail as close to the cuticle as possible, but, ideally, without touching it.

Thereafter, a polymerizing agent, such as an activator (for example, ethyl acetate and dimethyltolylamine) may be gently applied on all five fingernails (and toenails if being manicured) to cause a polymer reaction with the powder, resulting in a nail polish layer being applied to the user's nail.

Thereafter, the nail may be gently filed and shaped if deemed desirable. Thereafter, the surface may be smoothed with a buffer, and any dust removed from the entire hand.

Thereafter, the activator may be re-applied to all ten fingers/toes. Then, a thin layer of finishing liquid should be applied to three-quarters of the nail, leaving a small space between the nail and the cuticle on each finger. Thereafter, another coat of finishing liquid may be applied to the entire nail, preferably close to the cuticle but not touching it. The finishing liquid is preferably ethyl cyanoacrylate, without supplements such as vitamin A, vitamin B or calcium. However, it is to be understood that the finishing liquid may contain such, or other, supplements, or any other additives to enhance the performance or other characteristics of the product.

Thereafter, the nails may be air dried and the hands thoroughly washed and dried. Finally, further products may be applied, such as cuticle oil, to all ten fingers/toes.

Retail Kit

The instant invention contemplates a retail kit which may include a finger guide and a supply of the necessary tools and materials to apply a French manicure in accordance with the disclosure herein at home.

The kit includes a supply of a first-color acrylic nail powder which, when applied to one or more finger or toes nails of a user and reacted with the nail glue and activator of the invention, forms a first-color nail polish; a supply of a second-color acrylic nail powder, which when applied to one or more finger or toes nails of a user and reacted with the nail glue and activator of the invention, forms a second-color nail polish (it being understood that either the first or second colors may be a "clear" nail polish); at least one finger guide adapted to be selectively associated with the first and second-color acrylic nail powders, the one or more finger guides adapted to support at least one finger or toe of a manicure recipient during the application of a French manicure; a first quantity of nail glue; and a quantity of activator which, when applied to the nail of a recipient which already has nail glue and one or more nail polish colors thereon, will react and cause the nail glue and nail powder to harden, creating a nail polish coating on the nail.

Additionally and optionally, the kit may include an adhesion promoter in the form of a cleaner/prep liquid such as ethyl acetate used to clean and, thereby, prepare the finger or toe nails for application of nail polish thereon; one or more skin softeners such as cuticle oil; one or more brushes adapted to apply the adhesion promoter, nail gel, activator and/or the cuticle oil; and one or more brush cleaners to clean the aforementioned brushes when through.

It is to be understood that more or less than two different colors may be applied to finger or toe nails in the process of using the apparatus and kit of this invention. The fact that two colors is discussed in detail herewith is not intended to limit the scope of the invention. Therefore, it is to be noted that one color, or more than two colors, may be applied using the apparatus, kit and methods disclosed herein.

It is also to be understood that the nail polish which may be supplied with the kit of this invention and which may be employed with the apparatus and methods disclosed herein may be a silica powder-based material, or may be any of the known liquid nail polishes. The powder-based nail polishes are preferable for use with the instant invention as any powder which touches an area of a user's finger or toe which the user does not desire to cover with polish may simply be tapped or wiped off of the area(s) where polish is not desired. This can be done with liquid nail polish, but it is messier and, therefore, more cumbersome.

Suitable acrylic nail polish powder, nail glue and activators used to create nail polish coatings on finger and toe nails in accordance with this invention may be any of the known compositions, such as the CCS Powders and Liquids offered by California Chemical Specialties. Among them are the Arctic Fast Set Ultra White, which is comprised of polyethylmethacrylate, acrylates copolymer, titanium dioxide (Cl 77891) and benzoyl peroxide. The pink acrylic nail polish powder referenced herein may be the product sold under the brand name Dark Red Pink, comprised of acrylates copolymer, benzoyl peroxide, titanium dioxide (Cl 77891), Red 6 Barium Lake (Cl 15850), Red 7 Calcium Lake (Cl 15850) and iron oxides (Cl 77499). The clear acrylic nail polish powder referenced herein may be comprised of polyethylmethacrylate, benzoyl peroxide, PEG-12 dimethicone and silica silylate.

The following steps may be followed to apply a French manicure using the kit of this invention:

Provide a manicure, push back cuticle and trim cuticle if needed.

With a nail file, cut and file the nails to desired shape (e.g. squared or round).

Gently roughen the entire nail surface with a nail file or buff to remove the excess cuticle and shine from the nail bed.

Remove dust from the hand and nails using a nail brush or the like.

Apply the adhesion promoter to all nails to be manicured.

Working with one finger at a time on one hand, apply the nail glue to the nail. It may be desired, but is not necessary, to apply the nail glue to only a portion (e.g. ¾) of the nail and leave the balance of the nail area up to the cuticle uncoated. This prevents the manicure coating on the nail from being too thick near the cuticle, which would cause an unnatural transition from nail to cuticle.

Place the finger on the finger guide such as 20 or 60. Then, steadily move the finger and/or container 25 or 50 to immerse the tip of the nail in the white acrylic nail powder to acquire the desired French curve line. As stated above, to create a curve having a smaller radius, the finger should be oriented closer to horizontal, and to create a curve having a larger radius the finger can oriented closer to vertical.

Tap the excess white acrylic nail powder so that any powder that has temporarily attached to the skin falls off, and immediately immerse the entire nail into a pink or clear silica powder and tap finger to again remove any excess powder.

Gently apply a second coat of the nail glue on the entire nail. Preferably, one would apply the nail glue close to the cuticle, but not touching it.

Repeat the steps of immersing the tip of the nail in the white powder to re-cover the French tip and tapping off any excess powder, and immersing the entire nail in a pink or clear powder and tapping off any excess, for a second dip, if desired.

Then, gently apply a third coat of nail glue on the entire nail preferably as close to the cuticle as possible but not touching it.

Gently apply the activator on all five fingers (one hand/foot at a time), and allow to air dry.

Quickly apply the finishing gel to all nails.

Air dry for a short period of time, e.g. 2 minutes.

With a nail file or brush, file/brush underneath the nails and side wall to remove excess powder.

Repeat these steps for the next hand/foot.

Wash and dry hands/feet thoroughly.

Optionally, finish by applying a moisturizer such as cuticle oil to all manicured fingers/toes.

It is to be understood that, although the use of the nail powder colors white and pink have been disclosed herein, any other colors and/or color combinations are contemplated.

Benefits, other advantages, and solutions to problems have been described above with regard to specific embodiments of the present invention. However, the benefits, advantages, solutions to problems, and any element(s) that may cause or result in such benefits, advantages, or solutions to become more pronounced are not to be construed as a critical, required, or essential feature or element of any or all the claims. The invention is defined solely by the appended claims including any amendments made while this application is pending and all equivalents of those claims as issued.

The invention claimed is:

1. A device for use in applying a French tip manicure to a user using one or more acrylic powder-type nail polishes, the device comprising:

a container adapted to receive a quantity of acrylic powder-type nail polish;

a guide member associated with the container, the guide member sized and shaped to receive a finger or toe of a user, said guide member defining an upwardly facing concave surface adapted to cradle the finger or toe, said surface being oriented at an angle of between approximately 35 degrees and 55 degrees relative to horizontal; and the guide member supported adjacent a rim of the container and being positioned in such a manner relative to the container that the user may place his or her finger or toe on the guide member and, using the guide member, slide the finger or toe along the guide member to immerse all or a portion of a fingernail or toenail of the user into the nail powder within the container.

2. The device of claim 1, wherein the guide member is removably connected to the container by a support member comprising an outer wall member and an upper wall member, either the outer wall member or the upper wall member, or both, being connected to an underside of the guide member, the outer wall member and the upper wall member forming a shoulder adapted to be removably connected to the rim of the container.

3. The device of claim 1, wherein the guide member is associated with the container by a support member comprising an inner wall member, an outer wall member and an upper wall member, the inner wall member, upper wall member and outer wall member forming a channel adapted to be placed in substantial registry with at least a portion of the rim of the container.

4. The guide member of claim 1, further comprising an interior wall of the container being disposed at an angle relative to vertical to urge an upper surface of any powder contained within the container to remain substantially horizontal.

5. A kit for use in applying a French manicure to a user using acrylic nail powder and an activator, the kit comprised of:

a quantity of a first acrylic nail polish powder;

a quantity of a second acrylic nail polish powder;

a container adapted to receive a quantity of acrylic nail polish powders, the container comprising:

a guide member sized and shaped to receive a finger or toe of a user, said guide member defining an upwardly facing concave surface adapted to cradle the finger or toe, said surface being oriented at an angle of between approximately 35 degrees and 55 degrees relative to horizontal;

a guide support member connected to the guide member and capable of supporting the guide member on a rim of the container in such a manner that the user may place his or her finger on the guide member and, using the guide member, slide the finger along the guide member to immerse all or a portion of a fingernail or toenail of the user into the nail powder within the container;

a liquid polymerizing agent adapted to be applied over the powder on the user's nail to cause a polymer reaction between the powder and the polymerizing agent, resulting in a nail polish coating being applied on the nail.

6. The kit of claim 5, further including an adhering medium which is adapted to be placed on nails of the user to be polished prior to application of the nail polish powder.

7. A method for applying a nail polish treatment to a fingernail or toe nail, comprising the steps of:

applying an adhering medium to a nail to be polished;

providing a quantity of a first acrylic nail powder;

providing a finger or toe guide in association with the quantity of first nail powder, the finger or toe guide comprising;

a guide member sized and shaped to receive the finger or toe of a user;

apparatus for supporting the guide member in operable association with the quantity of first nail powder;

placing the finger or toe supporting the nail to be polished on the guide member, and using the guide member to slide the finger or toe along the guide member while immersing all or a portion of the nail to be polished into the nail powder to thereby deposit a quantity of said powder on to the fingernail or toenail; and coating the thus-deposited powder on the fingernail or toenail of the user with an activator.

8. The method of claim 7, wherein the step of immersing all or a portion of a fingernail or toenail of the user into the nail powder consists of immersing only a tip of the fingernail or toenail into the nail powder, and further including the steps of:

after the step of immersing the tip of a fingernail or toenail of the user into the nail powder, immersing all of the fingernail or toenail into a second nail powder; and applying the activator over the first and second nail powders deposited on the fingernail or toenail.

* * * * *